US005263215A

United States Patent [19]

Moon

[11] Patent Number: 5,263,215

[45] Date of Patent: Nov. 23, 1993

[54] WASHING METHOD OF A BOILING CLOTHES WASHING MACHINE

[75] Inventor: Kyung H. Moon, Suweon, Rep. of Korea

[73] Assignee: Samsung Electronics Co., Ltd., Suwon, Rep. of Korea

[21] Appl. No.: 963,544

[22] Filed: Oct. 20, 1992

[30] Foreign Application Priority Data

Oct. 21, 1991 [KR] Rep. of Korea ..... 91-18530

[51] Int. Cl.[5] ..... D06F 33/02

[52] U.S. Cl. ..... 8/158; 8/159; 68/12.03; 68/12.04; 68/12.22

[58] Field of Search ..... 8/158, 159; 68/12.02, 68/12.03, 12.04, 12.22

[56] References Cited

U.S. PATENT DOCUMENTS 5,133,200 7/1992 Tanaka et al. ..... 68/12.03

FOREIGN PATENT DOCUMENTS 8104418 8/1982 Netherlands ..... 8/158

*Primary Examiner*—Philip R. Coe

*Attorney, Agent, or Firm*—Burns, Doane, Swecker & Mathis

[57] ABSTRACT

A washing method for a boiling clothes washing machine having a heater which provides a method for dissolving enzyme detergent in washing water. The washing water is heated to a temperature for activating the enzyme detergent, and then the clothes to be washed are drenched. Another method for dissolving the enzyme detergent in the washing water is to heat the washing water along with clothes to the boiling point, thereby obtaining sterilization, deodorization and bleaching. This method reduces the amount of washing water to be supplied and also reduces the washing time.

2 Claims, 4 Drawing Sheets

WASHING METHOD OF A BOILING CLOTHES WASHING MACHINE

BACKGROUND OF THE INVENTION

1. Field of the Invention

The present invention relates to a washing method for a boiling clothes washing machine including a heater for boiling washing water, and particularly, to a washing method for a boiling clothes washing machine for washing clothing with water having the appropriate temperature. The water temperature is set in accordance with the contamination degree of fabrics or cloth materials to be washed, thereby increasing the effectiveness of the washing.

2. Background of the Invention

Modern enzyme detergents have been developed to promote washing performance as well as facing the social problem of environmental pollution. Water pollution is becoming especially worse. The enzyme detergent is used in a washing machine through a washing method called "DRENCHING WASH". It has somewhat increased the washing effectiveness. The drenching wash method includes the steps of supplying washing water to the tub of a washing machine, dissolving the enzyme detergent in the washing water, inserting clothes into the washing water and then drenching them in the washing water and continuing to perform the general washing procedure. The general washing procedures include the actual wash for rubbing off the dirt from clothes by rotating a pulsator in both the forward and reverse directions, the draining of water, the dehydration of water, the supply of water, the rinsing, the draining of water, and the dehydration of water.

However, the enzyme detergent is effective only when the water temperature is maintained at an appropriate temperature, for example 50° C. A conventional washing machine performs a drenching wash without heating the washing water, and this results in prolonging the washing period. Furthermore, the conventional washing machine does not provide the expected washing results that one may desire.

In view of these problems, a washing machine having a heater for heating the washing water in the tub has been developed. The washing machine referred to below as "a warming clothes washing machine" heats the washing water by about 50° C., so that it increases the cleaning effect of the drenching wash. Such a washing machine is not expected to sterilize, deodorize, and bleach when processing clothes at a high temperature, for example 95° C. The warm water is also not expected to wash badly contaminated clothes at the optimal cleaning level that one may desire. It is known through experience that the boiling clothing process is well adapted for badly contaminated clothes, thereby providing better results along with sterilization, deodorization and bleaching.

An object of the present invention is to provide a washing method for a boiling clothes washing machine including a drenching wash method for changing the temperature of the washing water which is dependent upon the active temperature of an enzyme detergent.

Another object of the present invention is to provide a washing method for a boiling clothes washing machine for heating washing water to the boiling point to provide sterilization, deodorization and bleaching effects.

Another object of the present invention is to provide a washing method for a boiling clothes washing machine for increasing the effective performance at a shorter time interval when using less washing water.

SUMMARY OF THE INVENTION

The present invention comprises a washing method for a boiling clothes washing machine having a heater. A judgment is made whether a drenching wash mode or a boiling wash mode is selected. Washing water is then supplied to a tub at a predetermined water level which is dependent upon the weight of clothes. A drenching step is performed including the supply of heated washing water from a heater. The temperature of the washing water is maintained at the appropriate temperature for activating enzyme detergent. The clothes to be washed are drenched in a wash tank. An actual wash step of turning off the heater and agitating the clothes is performed. Then two routines are performed. One routine includes the selection of the boiling wash. The washing water of the boiling wash is drained to a predetermined level dependent upon the volume of the clothes. A boiling step of heating the washing water to the boiling temperature for processing clothes is performed. The heater is then turned off, and a second water supply step of draining the washing water is performed. The clothes are then dehydrated and fresh washing water is supplied to the tub at the predetermined water level corresponding to the volume of the clothes. A rinsing step is then performed. An additional complete draining step and an additional secondary dehydrating step are performed. The second routine is that the boiling wash is not selected. The second water supply step of draining the washing water is performed. The clothes are dehydrated and fresh washing water is supplied to the tub at a predetermined water level corresponding to the volume of clothes. A rinsing step is performed. An additional secondary complete draining step and an additional dehydrating step are then performed.

That is to say, if the boiling wash is selected, washing water is supplied to the water at a predetermined level depending upon the volume of clothes. Then the enzyme detergent is thrown into washing water. The washing water is heated using the heater to the temperature for activating the enzyme detergent. Meanwhile the clothes are drenched during the heating period. Next, the clothes are washed by a pulsator which is rotated in both forward and reverse directions in order to wash the dirt from the clothes. The washing water is drained until the water level is such that clothes are totally immersed. Next, the washing water is heated to the boiling point along with clothes. After a predetermined time lapse, the heater is turned off, and the clothes are processed through a first complete draining, a dehydrating, a secondary water supply, a rinsing and a dehydrating to complete the total cleaning process. Therefore, the boiling wash mode is mainly used for clothes which can withstand a high temperature, which are terribly contaminated, and which will not lose their print. This mode is also useful for white clothes which require bleaching.

On the other hand, the drenching wash mode is similar to the boiling wash mode except for the intermediate draining step and the boiling step. Therefore, this mode is mostly used for clothes, which may be damaged at a high temperature or having a lower degree of contamination.

BRIEF DESCRIPTION OF THE DRAWINGS

The present invention will now be explained in detail with reference to the accompanying drawings, in which.

DETAILED DESCRIPTION OF THE INVENTION

Figure 1:
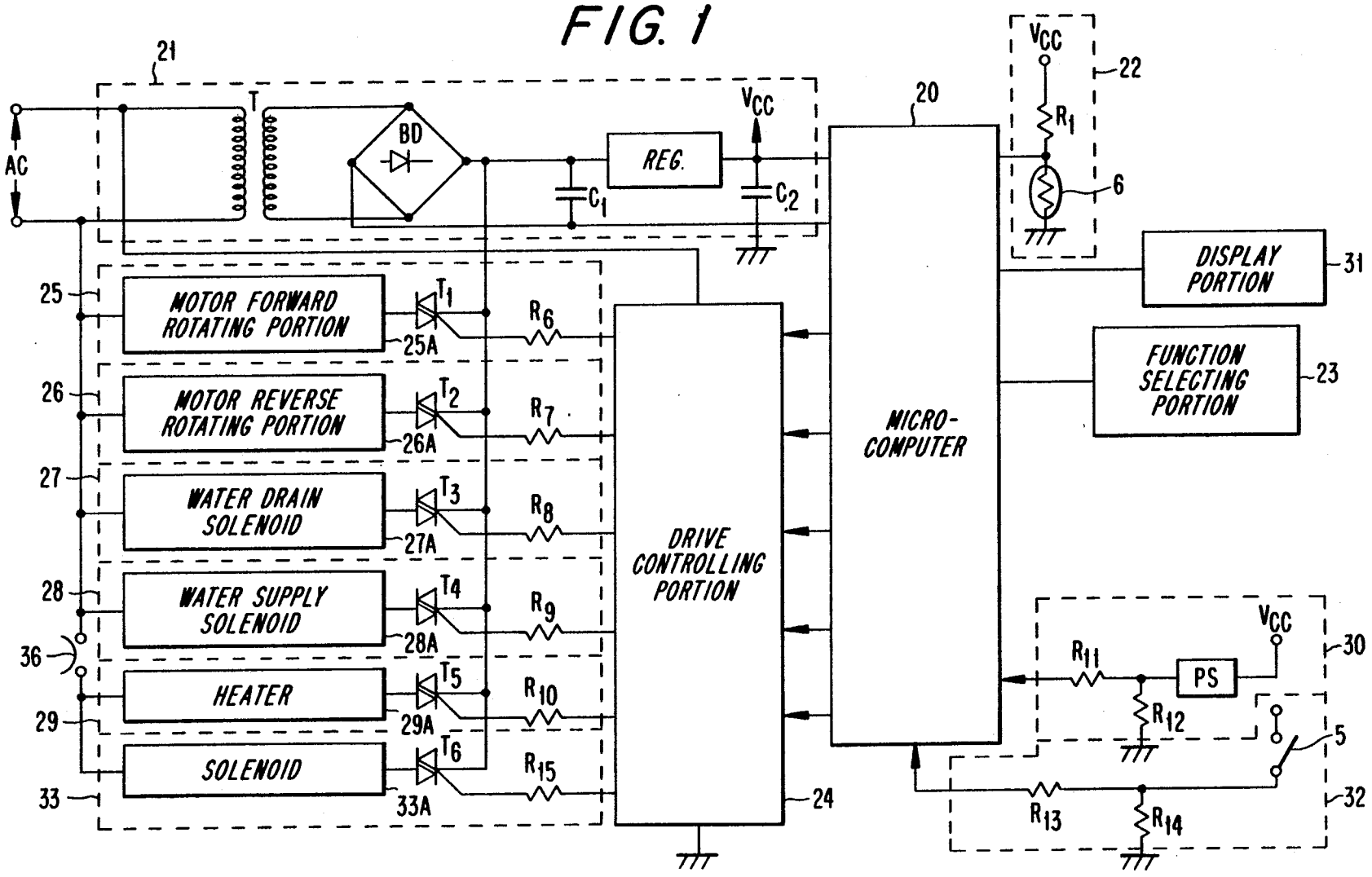
FIG. 1 generally depicts a washing machine control circuit adapted to a washing method for a boiling clothes washing machine according to the present invention; and, FIGS. 2A, 2B and 2C are a flow chart showing a washing method for a boiling clothes washing machine according to the present invention.

Referring to the drawings, according to the present invention a boiling clothes washing machine includes a tub made of a heat resistant material that is not damaged at temperature over 100° C. or catches fire. The washing machine also includes a high performance heater capable of heating a large amount of washing water.

As shown in FIG. 1, the present invention includes a control circuit provided with a microcomputer 20 to control the total operation of the boiling clothes washing machine according to a predetermined system program.

A power source supply portion 21 includes a transformer T, a bridge diode portion BD, condensers $C_1$ and $C_2$ and a precision regulator REG to rectify the alternating current into a constant power source so as to supply the regulated voltage Vcc to the system.

A washing water temperature detecting portion 22 includes a thermister 6 and a resistor $R_1$ to sense the temperature of the washing water to be supplied to the tub (not shown).

A function selecting portion 23 selects the wash mode or a procedure, and it selects the operating times corresponding to each mode or procedure.

A drive controlling portion 24 operates a number of loads under the control of the microcomputer 20 according to the output signals from the washing water temperature detecting portion 22 and the function selecting portion 23.

A motor forward rotating drive portion 25 includes a motor forward rotating portion 25A for rotating the motor, forwardly, a triac $T_1$ triggered by the output signal from the drive controlling portion 23, and a resistor $R_6$.

A motor reverse rotating drive portion 26 includes a motor reverse rotating portion 26A for rotating the motor, reversely, a triac $T_2$ triggered by the output signal from the drive controlling portion 23, and a resistor $R_7$.

A water drain drive portion 27 includes a water drain solenoid valve 27A for draining the washing water, a triac $T_3$ triggered by the output signal from the drive controlling portion 23, and a resistor $R_8$.

A water supplying drive portion 28 includes a water supply solenoid valve 28A for supplying the washing water, a triac $T_4$ triggered by the output signal from the drive controlling portion 23, and a resistor $R_9$.

A heater operating portion 29 includes a heater 29A for heating the washing water, a triac $T_5$ triggered by the output signal from the drive controlling portion 23, and a resistor $R_{10}$.

A water level sensing portion 30 includes a pressure sensor PS and resistors $R_{11}$ and $R_{12}$ to sense the level of washing water to be supplied.

A display portion 31 displays the completion of each of washing procedure, the function selection and so on.

A tub cover opening/closing portion 32 includes a tub cover sensing switch 5 for sensing the opening/closing of the tub cover, and it includes resistors $R_{13}$ and $R_{14}$.

A tub cover locking/releasing portion 33 includes a solenoid 33A for locking/releasing the tub cover, a triac $T_6$ triggered by the output signal from the drive controlling portion 23, and a register $R_{15}$, so that the tub cover is locked on the tub during a boiling wash mode, a drenching wash mode and a dehydrating mode.

A thermostat 36 is connected between the heater operating portion 29 and one side of the transformer T to cut off the power source of the heater 29A, when the predetermined temperature of the heater 29A or the washing water is exceeded.

Figure 2A:
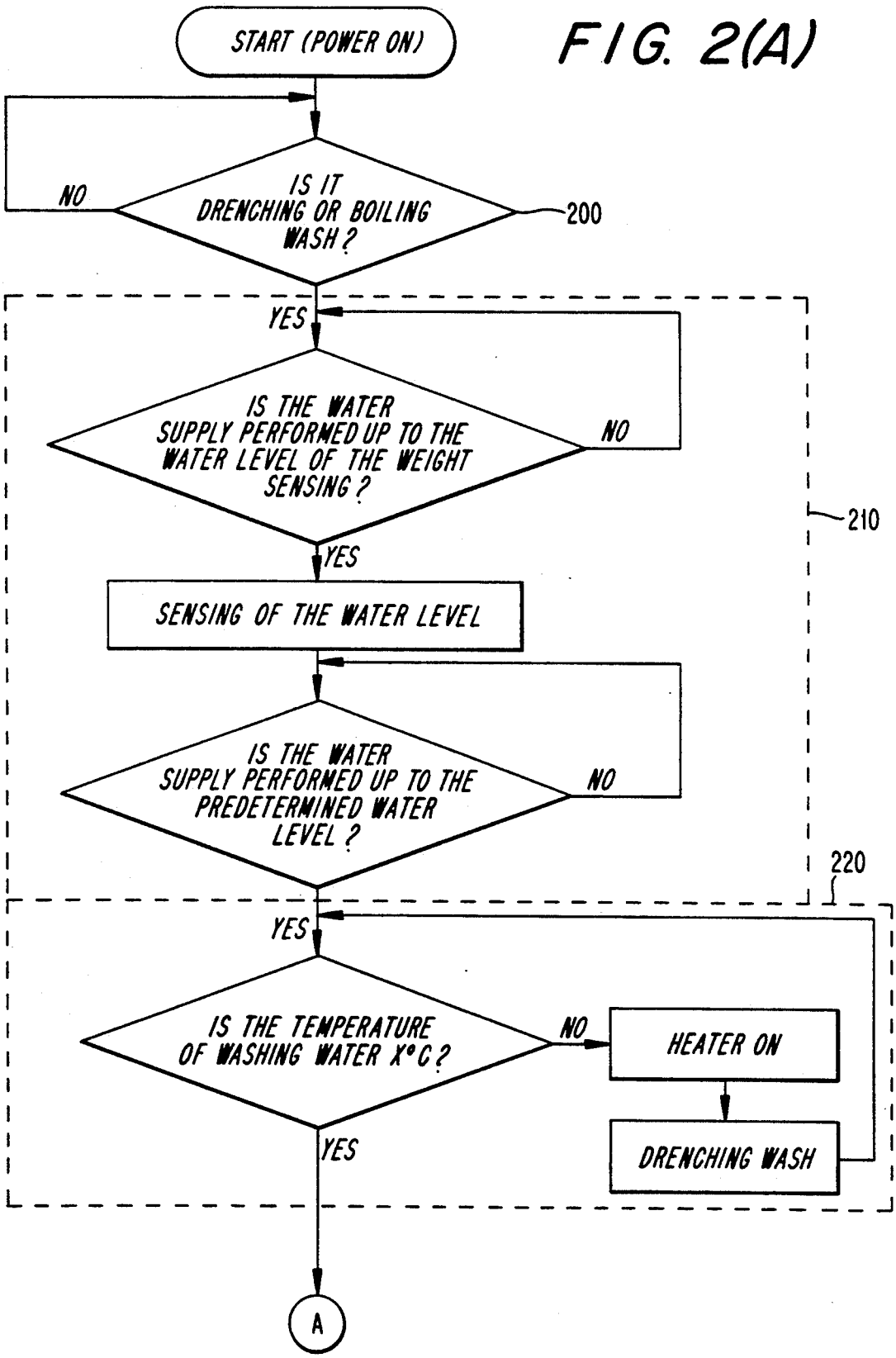
Figure 2B:
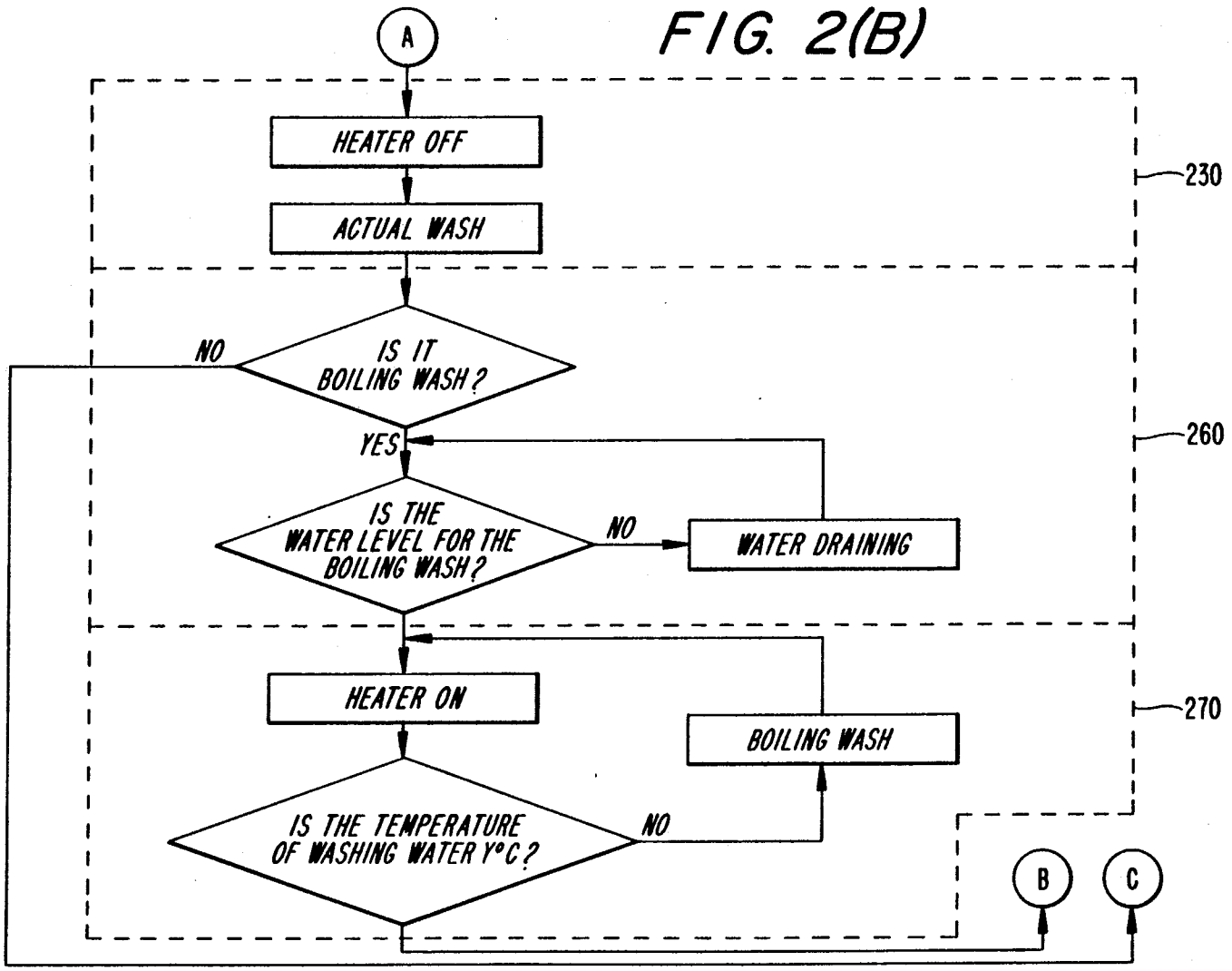
Figure 2C:
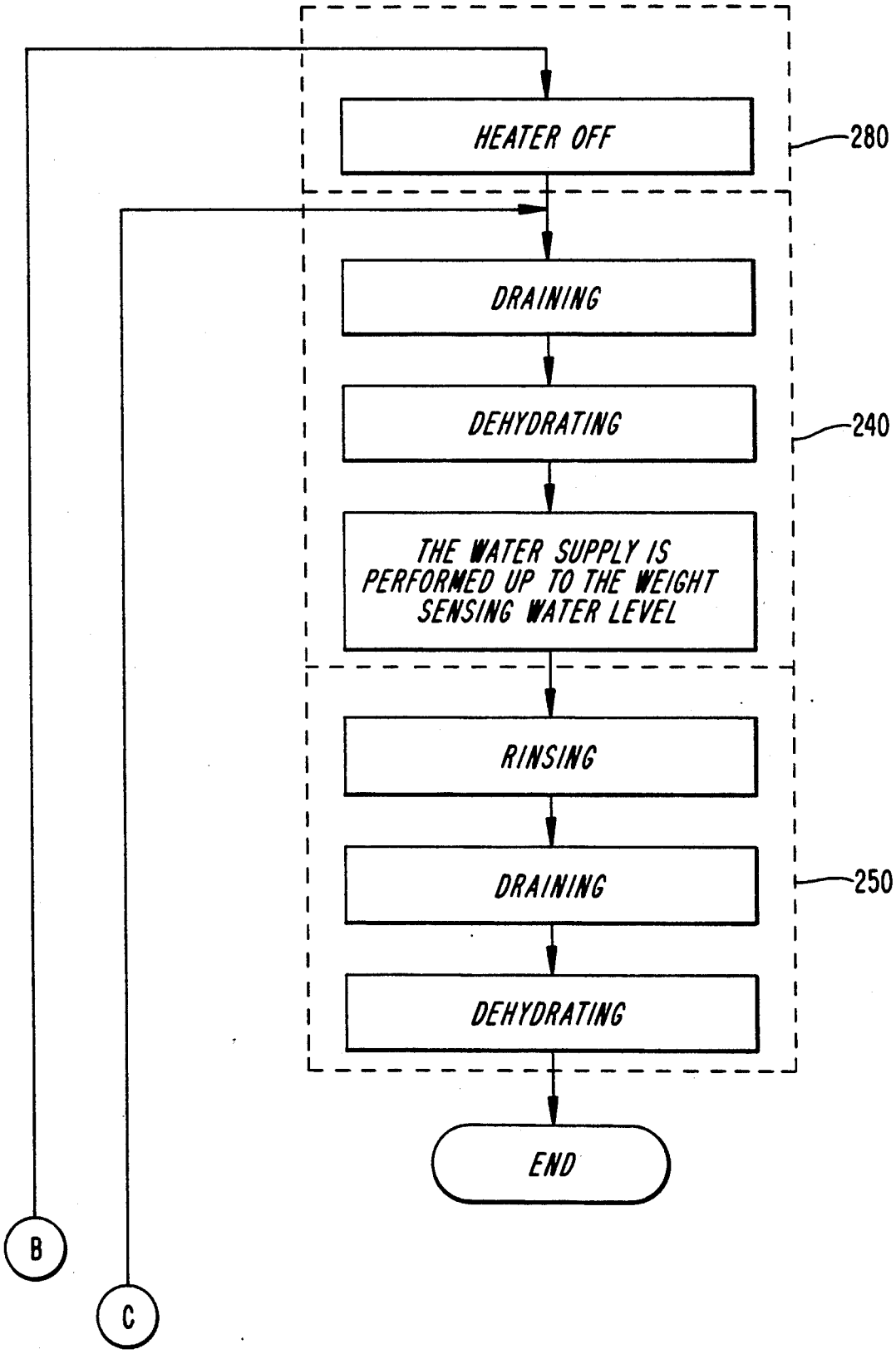

As shown in FIGS. 2A, 2B and 2C, firstly, a drenching wash mode may be selected when it is intended to wash clothes that are weak under a high temperature but seriously contaminated. At step 200, a microcomputer 20 outputs water supply control signals to operate the water supplying drive portion 28, if the drenching wash mode is selected. Therefore, at an initial routine 210, the water supplying drive portion 28 supplies the washing water to the tub at the predetermined water level which is dependent upon the volume of the clothes. At this time, the water level is exactly sensed by the water level sensing portion 30.

Next, the initial routine 210 goes to a drenching routine 220, if the completion of the water supply is confirmed. The enzyme detergent is prepared for dissolution in the washing machine, and the microcomputer 20 turns on the heater operating portion 29 through the drive controlling portion 24 in order to operate the heater 29A. The heater 29A heats the washing water to a temperature X° C. appropriate for activating the enzyme detergent, for example 50° C. The clothes are drenched in the washing water during a heating period. If the drenching routine has ended, the actual wash routine 230 is performed, thereby turning off the heater 29A as well as rotating a pulsator (not shown) in forward and reverse directions so as to wash the dirt from the clothes.

After the completion of the actual wash, a first water supply routine 240 is performed to drain all the washing water, dehydrate the clothes and again supply fresh washing water to the predetermined water level which is dependent upon the volume of the clothes.

The first water supply routine 240 advances to a final routine 250 to rinse the clothes, drain the washing water and dehydrate the clothes. The drenching water is then terminated.

On the other hand, a boiling wash mode is selected, if it is intended to wash clothes which are not damaged at a high temperature over approximately 95° C., badly contaminated clothes and clothes which require breaching. The boiling wash mode is executed like the drenching wash mode until the actual wash routine 230. After the actual wash routine 230 is ended, an intermediate drain 260 is performed to drain the washing water, while maintaining a water level that keeps the clothes totally immersed. This step saves energy and promotes rapid washing.

Next, the intermediate drain routine 260 advances to a boiling wash routine 270, thereby causing the microcomputer 20 to turn on the heater 29A. The washing water is heated to the boiling point along with clothes. For example, at temperatures over 95° C. sterilization, deodorization and bleaching effects are obtained. After a predetermined time lapse, the heater 29A is turned off at a heater turning off step 280. Thereafter a second water supply routine 240 and a final routine 250 are performed to complete the boiling wash. Therefore, it should be noted that both the drenching wash and the boiling wash are not limited to a particular enzyme detergent, because there is a broad temperature range.

As described above, according to the present invention a drenching wash is performed at a lower temperature of the washing water for activating enzyme detergent, while a boiling wash washes clothes with hot water, thereby obtaining the desired sterilization, deodorization and bleaching effects.

What is claimed is:

1. A washing method for a boiling clothes washing machine having a heater and a tub, comprising the steps of:

supplying washing water to the tub at a predetermined level dependent on the weight of the clothes;

detecting the temperature of the washing water, and heating the water to a first predetermined temperature, if the washing water is below the first predetermined temperature;

washing the clothes;

judging whether a boiling wash mode is selected;

supplying washing water to the tub at a predetermined level dependent on the weight of the clothes and heating the washing water to a second predetermined temperature with the heater, if the boiling wash mode is selected;

draining the washing water;

dehydrating the clothes;

supplying washing water to the tub at a predetermined level dependent on the weight of the clothes;

rinsing the clothes;

draining the washing water; and dehydrating the clothes.

2. A method according to claim 1 wherein the first predetermined temperature of the washing water is set in accordance with the type of enzyme detergent used to wash the clothes.

* * * * *